US006560905B2

(12) United States Patent
Monroe

(10) Patent No.: US 6,560,905 B2
(45) Date of Patent: May 13, 2003

(54) DEVICE FOR REMOVING SNOW AND OTHER DEBRIS FROM GROUND SURFACES

(75) Inventor: James C. Monroe, Auburn, ME (US)

(73) Assignee: SnoTech, Inc., Auburn, ME (US)

( * ) Notice: Subject to any disclaimer, the term of this patent is extended or adjusted under 35 U.S.C. 154(b) by 0 days.

(21) Appl. No.: 09/823,515

(22) Filed: Mar. 30, 2001

(65) Prior Publication Data

US 2001/0013181 A1 Aug. 16, 2001

Related U.S. Application Data

(63) Continuation-in-part of application No. 09/235,980, filed on Jan. 22, 1999, now Pat. No. 6,260,293.

(51) Int. Cl.[7] ..... E01H 5/09
(52) U.S. Cl. ..... 37/248; 37/196
(58) Field of Search ..... 37/196, 232, 233, 37/242, 244, 248, 253, 251, 256; 172/107; 15/21.1, 49.1, 52.2, 54, 55

(56) References Cited

U.S. PATENT DOCUMENTS

| | | | | | |
|---|---|---|---|---|---|
| 1,255,275 | A | * | 2/1918 | Barnett et al. | 37/248 |
| 1,545,235 | A | * | 7/1925 | Cole | 37/248 |
| 1,820,707 | A | * | 8/1931 | Moen et al. | 37/248 |
| 2,103,514 | A | | 8/1936 | Cole | |
| 2,171,075 | A | * | 8/1939 | Blazier | 15/79 |
| 2,941,223 | A | | 6/1960 | Klauer | |
| 3,021,661 | A | * | 2/1962 | Couberly | 56/364 |
| 3,315,381 | A | * | 4/1967 | Fisher | 37/24 |
| 3,393,462 | A | * | 7/1968 | Picker | 37/12 |
| 3,670,359 | A | * | 6/1972 | Gutbrod | 15/348 |
| 3,758,967 | A | * | 9/1973 | Thompson | 15/49 R |
| 3,886,675 | A | | 6/1975 | Maisonneuuve et al. | |
| 4,159,055 | A | * | 6/1979 | Eberle | 198/512 |
| 4,583,307 | A | * | 4/1986 | Lenert | 37/233 |
| 4,602,400 | A | * | 7/1986 | Agergard et al. | 15/79 A |
| 4,760,657 | A | * | 8/1988 | Ganzmann et al. | 37/232 |
| 4,951,403 | A | * | 8/1990 | Olmr | 37/262 |
| 5,077,920 | A | * | 1/1992 | Farrell | 37/247 |
| 5,101,585 | A | * | 4/1992 | Gerbrandt | 37/252 |
| 5,133,139 | A | * | 7/1992 | Rzechula | 37/219 |
| 5,209,003 | A | | 5/1993 | Maxfield et al. | |
| 5,398,431 | A | * | 3/1995 | Beihoffer et al. | 37/249 |
| 5,445,438 | A | * | 8/1995 | Drumm | 300/21 |
| 5,540,004 | A | * | 7/1996 | Patterson et al. | 37/244 |
| 5,588,230 | A | * | 12/1996 | Bath et al. | 37/190 |
| 5,735,064 | A | * | 4/1998 | Holl | 37/260 |
| 5,966,846 | A | * | 10/1999 | Harms et al. | 37/249 |

* cited by examiner

*Primary Examiner*—Thomas B. Will
*Assistant Examiner*—Kristine Florio
(74) *Attorney, Agent, or Firm*—Patricia M. Mathers; Thomas L. Bohan

(57) ABSTRACT

A snow removal or ground-surface cleaning apparatus that is pushed or pulled by a prime mover. The apparatus has a drum array that includes rows of triple-stepped blade-like fingers distributed evenly around a drum array. These fingers are stiffly flexible and can cleanly and efficiently pick up snow and debris from uneven ground surfaces.

8 Claims, 7 Drawing Sheets

DEVICE FOR REMOVING SNOW AND OTHER DEBRIS FROM GROUND SURFACES

This application is a Continuation-in-Part of the commonly owned U.S. application Ser. No. 09/235,980, filed on Jan. 22, 1999 now U.S. Pat. No. 6,260,293, issued on Jul. 17, 2001.

BACKGROUND OF THE INVENTION

1. Field of the Invention

The present invention relates to a system for removing loose debris from streets and other surfaces. Particularly, the present invention relates to snow or ice removal from regular and irregular surfaces. More particularly, the present invention relates to a system that can be configured to perform various ground cleaning operations. More particularly yet, the present invention relates to a snow removal system that fractures the snow covering a surface, lifts the fractured snow from the surface, and discharges it through an impeller/discharge system. Most particularly, the present invention uses a stiff but flexible stepped triple finger mechanism to fracture and lift the snow and deliver it to an impeller assembly that transfers the snow and laterally discharges it, at an adjustable height above the surface from which it is expelled.

2. Description of Prior Art

Although the utility of the present invention is not limited to snow removal, the relevant prior art lies in the field of snow removal mechanisms. Among the many different means for removing snow from ground surfaces snowplows are the best known. Nevertheless, snow removal by snowplow has a number of inherent disadvantages. A snowplow typically requires several passes to clear a roadway of snow. In the first pass, it clears a swath, discharging the snow to the side of the plow, thereby creating snowbanks that narrow the roadway and impair visibility for vehicle operators or pedestrians. In a subsequent pass or passes, the plow works at pushing the snowbank further away from the roadway. Furthermore, highway snowplows typically require a certain minimum forward speed if the plows are to impart to the snow the velocity needed for the snow to travel across the face of the plow. In congested traffic conditions in which the snowplow is prevented from maintaining this minimum speed, snow spillage may occur at the edge of the plow not intended to discharge snow, leaving ridges of snow in the middle of the roadway or causing the vehicle to stall. Also, snowplow blades are straight and rigid, designed to remove snow from regular surfaces. When they contact fixed protrusions from the surface, these blades may become bent or damaged in other ways, requiring costly repair or replacement. Also, the plow blade does not remove the snow from the ground cleanly, but rather, leaves surface recesses filled with snow.

Snowblowers have certain advantages over plows: they do not require a minimum forward velocity of the prime mover in order to move the snow and, depending on the orientation of the discharge outlet and the throw speed, they may avoid creating snowbanks at the roadside. Yet, there are also disadvantages inherent to snowblowers, existing in all of their many types. Snowblowers typically engage the snow by means of cutters, brushes, or augers, and transport the snow to a blower unit which discharges it to either side of the snowblower at some distance from the roadway. Cole (U.S. Pat. No. 2,103,514; 1937) teaches a system that uses a pair of rotary cutters to engage and then transport the snow or ice to a centrally located blower unit, which then discharges the snow or ice to either side of the vehicle as desired. Another system teaches the use of a rotary drum having blades located around its periphery to cut and lift snow and convey it to a discharge unit Maxfield et al. (U.S. Pat. No. 5,209,003; 1993). The rigidity of augers or cutters, as taught by the systems of Cole or Maxfield et al. creates several difficulties. For one thing, the leading edge of an auger or a rotary cutter is necessarily exposed to allow engagement with the snow; these rigid, churning augers or cutters make such snowblowers inherently dangerous to use. Furthermore, rigid augers and cutters can damage—or be damaged by—roadway protrusions, such as manhole covers or bridge joints, and, consequently, must be operated at some distance above the level of the surface to be cleared. This practice leaves residual snow on the surface. This means that systems that use augers or cutters can be used only in conjunction with other snow removal means, physical or chemical, if the snow is to be completely removed.

Snow blowers do exist that use brushes rather than rigid augers. E.g., Klauer (U.S. Pat. No. 2,941,223; 1960) teaches a manually operated system that uses two spiral brushes, oppositely wound around a rotating shaft, to transport snow to the center of the shaft. Alternatively, Maisonneuve et al. (U.S. Pat. No. 3,886,675; 1975) teaches the combined use of a rotating brush and an auger to engage snow and transport it to the blower unit. Rotating brushes, unlike rotating cutters and augers, can be operated in direct contact with the ground surface. Brushes, however, have a disadvantage in that the bristles in the brushes are round and, thus, only the snow particles that hit the leading edge of the bristles are propelled forward. All others are deflected laterally to varying degrees. Brushes also require a great deal of power to engage and lift the snow. This is because, typically, every bristle contacts the ground and, thus, every bristle bends, its tip contacting the ground. This results in the leading edge of the bristle actually facing downward before the bristle tip starts its desired forward and then upward movement as the tip loses contact with the surface. As a result, the snow is initially driven downward before it is propelled upward and forward. This results in a packing of the snow, making it more resistant to being passed through the rest of the device. Furthermore, since all the bristles drag on the ground, they encounter a frictional force that works against the direction of the brush rotation. This increases the power demanded to maintain that rotation at an effective rate.

As described above, snowblowers with brushes, augers or rotary cutters typically transport the snow to a centrally situated blower unit for expulsion. This means that the snow is handled for an extended period of time, as it travels from the outer edge of the snow collection means to the center, or, when dual snowblowers are used, as it travels from the center of snow collection device to the outer edges. The longer the snow remains in the system, the greater the volume of snow that is being handled or transported at any given time. Thus, snowblower systems must be designed to accommodate these large volumes and provided with the power required to move them. Also, the fact that snowblowers pack the snow as it is handled means that more power is required to transport the snow then would be the case with loose fluffy snow. Furthermore, the high-density, packed snow often causes the equipment to jam, leading to interruptions and potentially hazardous operations to clear the device.

Snow or debris removal systems are generally dedicated systems, i.e., a snow removal system is designed to remove only snow; a street sweeper is designed to remove only dirt and loose debris from the ground. As a consequence, cities, towns, and other entities that must be concerned with removing snow or debris from ground surfaces are required to invest in multiple costly devices to perform various necessary ground cleaning operations. It would be of great advantage if a system for removing snow and other debris could be rapidly and easily reconfigured as required to perform various ground surface cleaning operations, such as removal of frozen slush or fallen leaves or other loose debris, in addition to snow removal.

Therefore, what is needed is a snow removal device that will cleanly and safely remove snow from ground surfaces and discharge the snow without creating snowbanks that narrow the roadway or impair visibility. What is further needed is such a device that will fracture the snow into small, light units, thereby improving the operating speed, efficiency, and safety of such a device. What is yet further needed is such a device that will cleanly remove snow from irregular ground surfaces. What is still further needed is such a device that can be rapidly and easily reconfigured to perform various ground surface cleaning operations.

BRIEF SUMMARY OF THE INVENTION

It is an object of the present invention to provide a snow removal device that will cleanly and safely remove snow from ground surfaces and discharge the snow without creating snowbanks that narrow the roadway or impair visibility. It is a further object of the invention to provide such a device that will fracture the snow into small, light units. It is yet further an object of the invention to provide such a device that will remove snow from irregular ground surfaces. It is still further an object of the invention to provide a device that can be rapidly and easily reconfigured to perform various ground surface cleaning operations.

The apparatus of the present invention provides a novel means for cleanly and efficiently removing snow and other debris from ground surfaces, regardless of whether the surfaces are level. The equipment is safer to operate than either snowplows or auger-using snowblowers, it is easily accessible for cleaning and maintenance, and requires a minimal amount of operating energy. The basic units of the system of the present invention are a novel rotating pick-up assembly mounted in close proximity to an impeller assembly. The system can be contained on its own chassis and pushed in front of, or pulled behind, a prime mover such as a truck, or can be self-propelled, or mounted on another vehicle.

In its Preferred Embodiment, the removal system of the present invention is mounted on a floating chassis attached to and suspended from a "fixed" chassis that can be pulled or pushed. The fixed chassis is designed to support floating chassis of varying widths. The moving components of the system are powered by a hydraulic power unit, or other power means, that can be incorporated into the system, or provided externally. The basic units of the removal system are a pick-up assembly, an impeller assembly, and a discharge tube. The pick-up assembly consists of a drum array mounted on a drum shaft that runs parallel to the ground surface and perpendicular to the direction the system is intended to move. The drum array may be formed from a plurality of interconnected drums, or it may consist of an individual drum.

Most importantly, each drum carries an array of finger modules and each finger module includes an array of flat fingers, each of which is an elongated, thin element. Fingers offer distinct advantages over snow removal equipment that uses plow blades, augers, cutters, or rotary brushes. Made of a stiff, yet flexible material, they will flex when they come into contact with fixed protrusions on the surface, unlike rigid plow blades, augers or cutters. As a result, the fingers are much less likely to be damaged by objects on road surfaces; also, they will not damage protrusions on the ground surfaces such as manhole covers and bridge joints. This finger module is the heart of the present invention, which thereby provides advantages over rigid, straight-edged plow blades, rotary brushes and augers and cutters with respect to its ability to sweep surfaces clean of debris, including snow.

In the Preferred Embodiment, these stepped finger modules have three fingers: a leading finger, a middle finger, and a trailing finger, each successively longer. In the operating position, the distance of the pick-up assembly from the ground is adjusted so that the middle finger just grazes the mean level of the ground surface. With the drum rotating in a direction that causes the snow to be flicked forward to the impeller openings, the leading finger does not touch the road surface at all, but rather strikes the snow at some short distance above the ground. As this leading finger hits the snow, it fractures it, i.e., it breaks the snow into small particles, and, as the finger continues through into its forward and upward rotation, it lifts the snow particles into the vicinity of the impeller assembly intake. With the apparatus operating in this manner, the middle finger just grazes the ground surface and conveys forward and upward the snow that the leading finger left behind. The trailing finger, having a length greater than the distance needed to reach the ground, flexes and drags when it contacts a flat surface. Thus, it is able to scoop snow out of depressions in the road or ground surface. In short, the leading finger fractures and displaces the snow down to within an inch or so above the ground. Because it is just moving through snow, without scraping against the road surface, this lead finger encounters minimal "back forces" and, consequently, presents minimal drag on the drum rotation. The middle finger fractures and lifts the snow left by the leading finger, also transmitting little back force to the drum, since it just grazes the surface and does not have to flex and drag on the ground. The trailing finger, when it contacts the ground, does flex and scrape the ground, thus creating a back force on the drum. However, since it is not lifting any significant amount of snow (the bulk of the snow having already been cleared away by the leading and middle fingers), the ground resistance is about all that contributes to its drag. Thus, in contrast to snowblower systems or plows that compact the snow in the pick-up process, the pick-up assembly of the present invention breaks the snow into small units while it lifts it from the surface, cleanly and with a minimal force on the drum. The fingers offer a further advantage in that individual fingers can easily be replaced when they eventually become worn or damaged, in contrast to the large snowplow, auger, or brush assemblies, each of which can be very costly to replace.

The snow removal device of the present invention is intended to be used in connection with new snowfall as well as with packed snow. In normal operating mode, the lower half of the drum is rotating in the direction of travel of the system, with the shorter finger being the leading finger. For light fluffy snow, the direction of the rotation of the drum can easily be reversed, so that the lower half of the drum is rotating opposite the direction of travel. In this mode of operation, the longer finger becomes the leading finger, with the middle and shorter fingers providing a stiffening and strengthening of the leading finger. The snow is swept backward and upward, propelled around the drum, and driven from above into the impeller assembly. The advantages of operating the system in this reverse mode are twofold: the system can be operated at greater travel speeds, and less power is required to operate the drum.

The impeller assembly includes one or more impeller units. In the Preferred Embodiment, four impeller units are arranged in an array such that an axis that passes through the centers of them all is perpendicular to the direction of travel of the snow-removal apparatus and parallel to the pick-up assembly's drum shaft. The impeller assembly is mounted on the floating chassis adjacent to the pick-up assembly. The impellers are similar to fans that move large volumes of air. In this case, the action of the impellers creates a pressure gradient such that all snow brought near the intakes is sucked into them. Each impeller unit includes an impeller blade array attached to an impeller shaft and to an impeller base plate, and an impeller chamber formed by an impeller chamber cover and impeller chamber walls. The impeller blades rotate in impeller chambers and, as an impeller blade approaches the opening between the chamber and the discharge tube, the rotational impeller action flings the snow into the discharge tube whence it is expelled from the system. The direction of impeller rotation is reversible, therefore the snow can be discharged to either side of the system, as desired. The discharge tube lies in the same plane and is parallel to the impellers and, thus, discharges the snow transversely at a relatively low height, using to advantage the fling momentum of the impellers and reducing the danger of snow cloud formation.

In normal operation, the plane of the impeller intake is tilted only slightly upward toward the pick-up assembly; however, the section of the floating chassis that supports the impeller/discharge assembly can be pivotally attached to the section of the floating chassis that supports the pick-up assembly so as to allow the plane of the impeller intake to be tilted at a steeper angle. Increasing the angle of the plane of the impeller assembly/discharge tube relative to the ground brings the impeller intake closer to the pick-up assembly, thereby decreasing the distance the snow must travel between the exit point of the pick-up assembly and the impeller assembly intake. This is advantageous when clearing wet snow. Increasing the tilt of the impeller intake plane also raises the height of the discharge tube, changing the height and angle of discharge, which may be desired in certain conditions. The use of multiple impellers has distinct advantages over systems that utilize only a single or two blower units. The pick-up assembly does not need to transport the snow as far to deliver it to the impeller unit because of the proximity of the impeller assembly intake to the pick-up system. Also, the "negative" pressure that is created along the length of the pick-up assembly by the impeller action assists the delivery process by sucking the snow into the impellers. Furthermore, the snow is handled for a much shorter period of time before it is dumped into the discharge tube and, consequently, the use of multiple impellers reduces the volume of snow that is within the system at any one time. Thus, the impeller assembly handles the snow more efficiently and can be much more compact in design relative to other known snowblower systems of equivalent capacity.

Separate housings enclose the pick-up assembly and the impeller assembly/discharge tube so that during operation all sides, with the exception of the bottom of the pick-up assembly, are enclosed. This enhances the operating safety of the system because no moving parts of the apparatus are exposed during operation. Removable access covers can be opened to provide access to the pick-up assembly and the impeller assembly and discharge tube from above, making the assemblies readily accessible for cleaning and maintenance.

The apparatus of the present invention has three operating positions: an idle position in which the fingers of the pick-up assembly only reach to within one or two inches of ground level; a working position in which the middle finger just grazes the ground; and a transport position in which the entire device is raised and supported so that the fingers only come to within six to eight inches of the ground. For cleaning and maintenance operations, the floating part of the apparatus can be raised still further above ground level or the fixed chassis can be lifted from above to provide easy access to the pick-up assembly and the impeller assembly and discharge tube.

The device of the present invention is a versatile system that can be used for purposes other than snow removal. For example, the pick-up assembly with the finger modules can also be used for cleaning streets of debris in the summer. Furthermore, the drum with the finger modules can be easily and conveniently removed and replaced with another drum, such as a drum fitted with special blades or chains for removing ice, or with a brush for removing sand from the road in the spring. Furthermore, the versatility of the system is enhanced by the fact that the fixed chassis of the system can support varying widths of a floating chassis and the fact that the drum can rotate in a forward or reverse direction relative to the direction of translational travel.

The drum array according to the invention, is also, by itself, a device that can be used for many different ground surface cleaning operations. For example, the drum array with the blade-like fingers can be mounted in a conventional airport or runway broom and be used to clear runways of snow, sand, leaves, and other types of debris. Indeed, the drum array can be appropriately sized and mounted in any number of different power sweepers, such as, in relatively small, powered sweepers for home use or in large sweepers for municipal street-cleaning operations. The drum array can be front-mounted, rear-mounted, loader-mounted, or towed behind a vehicle.

In summary, the present invention includes a drum array with blade-like fingers that can be used with any number of powered ground-surface cleaning equipment, and a ground-surface cleaning apparatus that includes a pick-up assembly with the drum, an impeller assembly and a discharge tube. The pick-up assembly and the impeller assembly are both mounted on a floating chassis that in turn is mounted on a fixed pullable or pushable chassis. The drum of the pick-up assembly and the blades of the impeller assembly are driven by hydraulic motors mounted on the floating chassis. All moving parts of the system are enclosed in housings or under hoods during operation, greatly improving the safety of operating such a system. As the drum in the pick-up assembly rotates, the stepped, triple-finger modules fracture the snow and lift it into the vicinity of the impeller assembly, where it is sucked into the impellers and discharged to either side of the system through the discharge tube. The use of stepped fingers allows the snow to be broken up into small units, rather than be compacted, as is the case with snowplows and brush, auger, or cutter snowblowers. This offers several advantages: the snow is lighter and easier to transport, less power is required for its transportation, and the fracturing action of the fingers reduces the probability of the snow packing while being handled, thus increasing safety and efficiency. The use of flexible-yet-stiff fingers offers further advantages in that the fingers clean uneven road surfaces of snow efficiently and without damage to the snow removal equipment or to protrusions from the road surface such as manhole covers and bridge joints. The use of fingers is also cost effective, as the fingers can be replaced individually should they become worn or damaged. The use of multiple impellers provides a more efficient, compact design than the use of simply one or two impellers and also creates a suction force that aids in delivering the snow into the discharge assembly. Furthermore, the location of the discharge tube allows for relatively low transverse discharge, thus reducing the formation of snow cloud and improving visibility for other vehicles and pedestrians in the vicinity of the operating system. A device for removing snow or other debris from ground surfaces which has several different, easily and rapidly interchangeable drums, each configured to perform a certain ground cleaning operation, offers cost-saving advantages to entities that must acquire several different devices to perform the various typical cleaning operations on roads and other ground surfaces.

DETAILED DESCRIPTION OF THE EMBODIMENTS OF THE INVENTION

Figure 1:
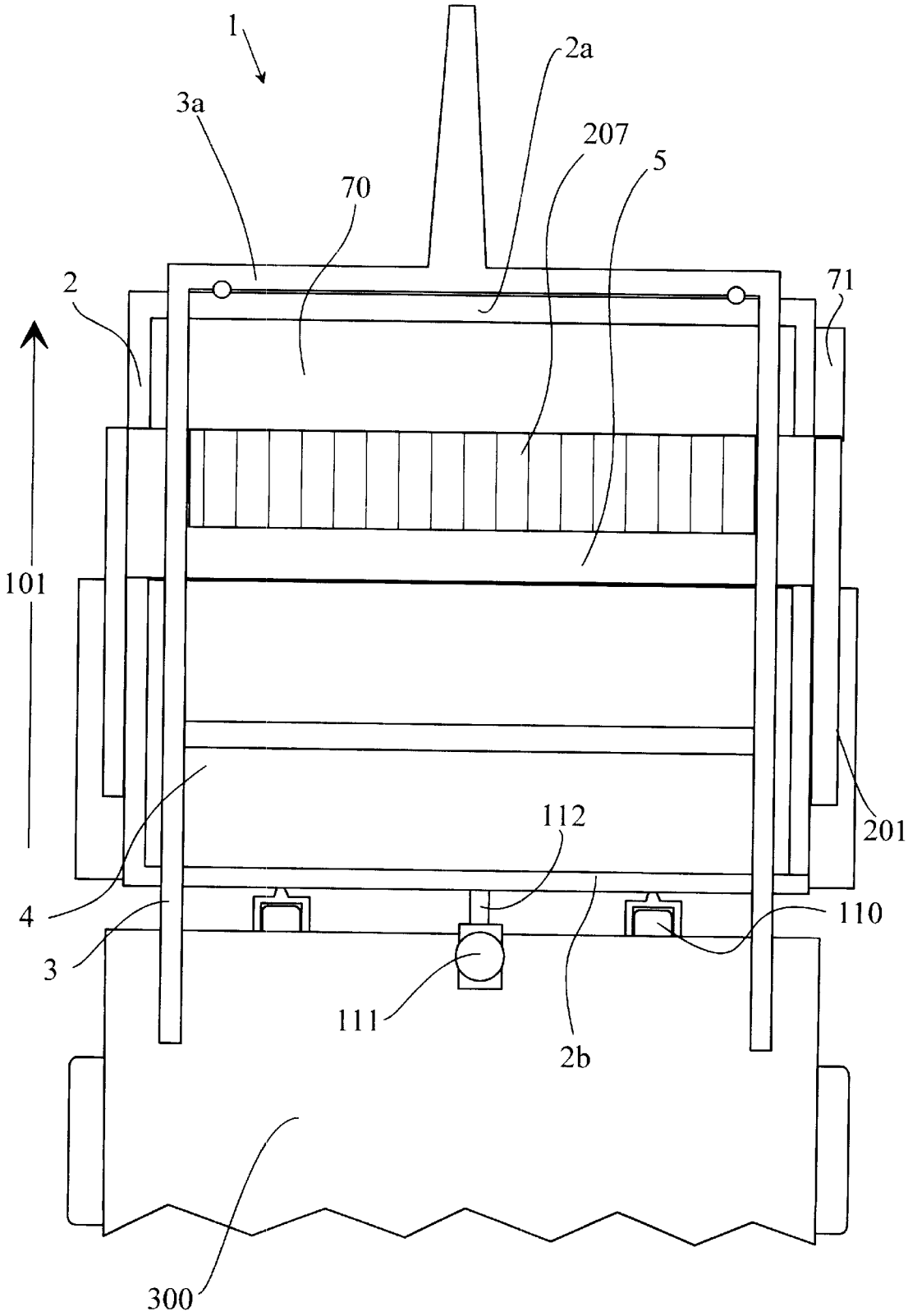
FIG. 1 is a top view of the system, shown as it appears during operation, fully enclosed in housings and with access covers closed.
Figure 2:
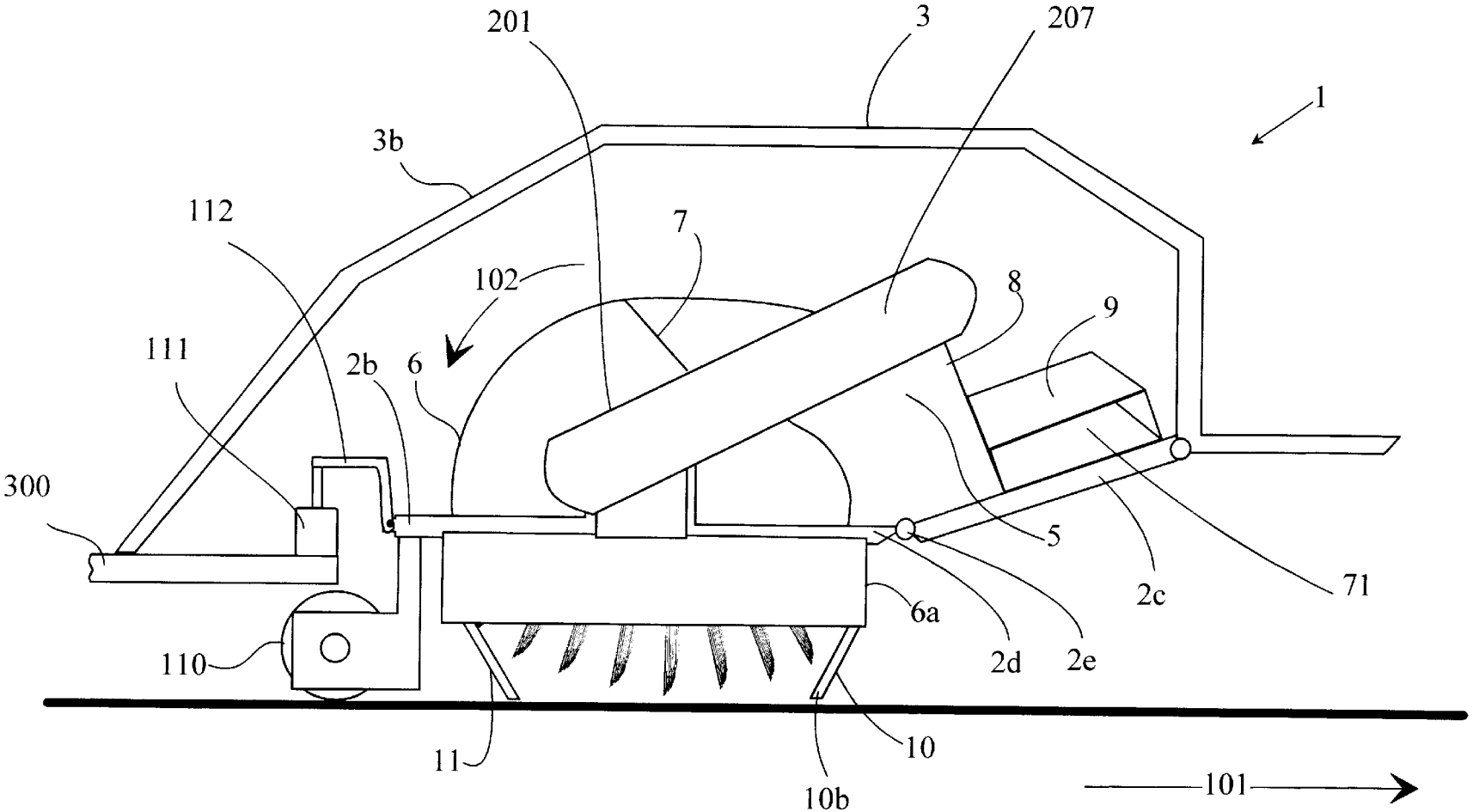
FIG. 2 is a side view of the system, shown as it appears during operations, fully enclosed in housings and with access covers closed.
Figure 10:
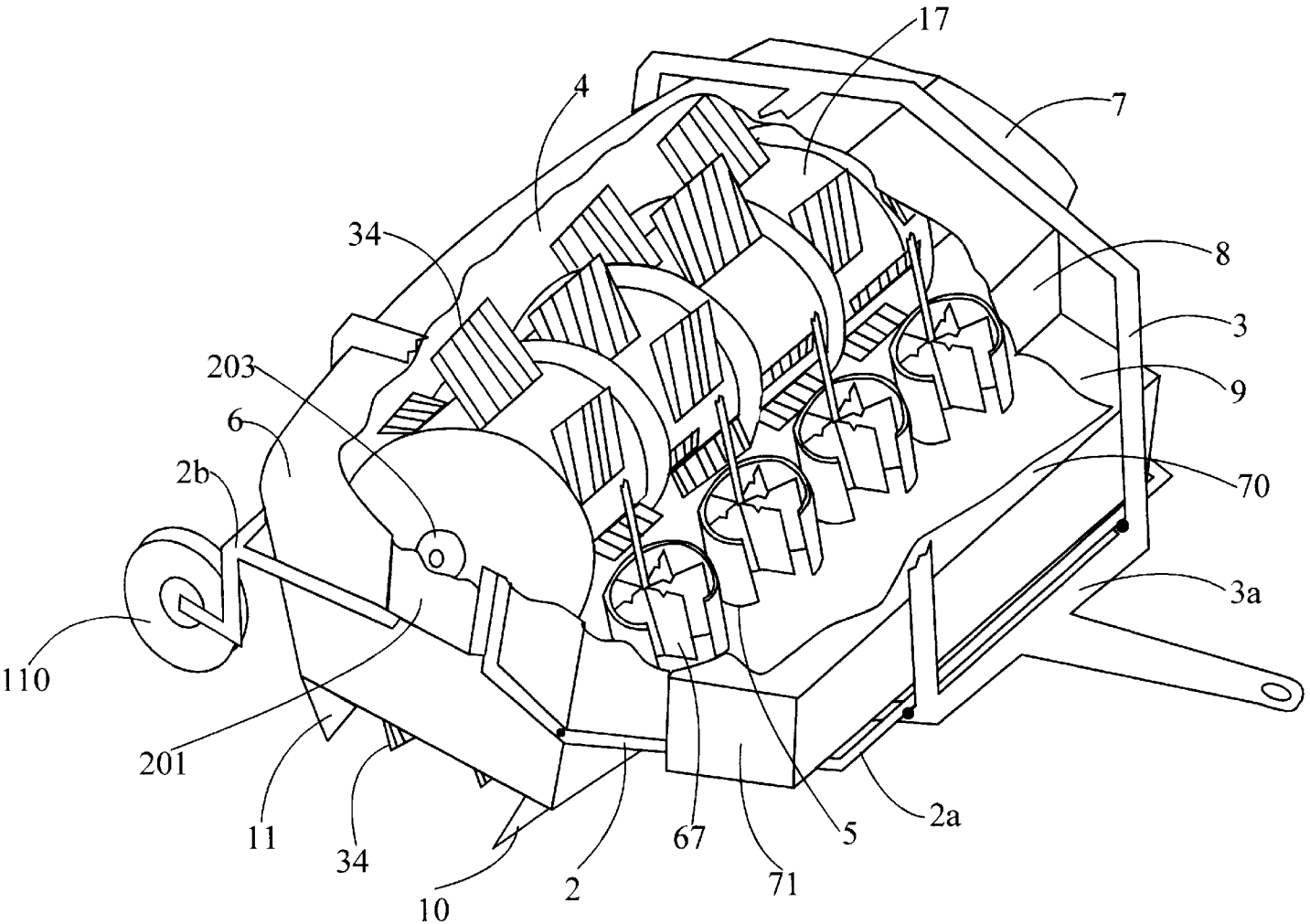
FIG. 10 is a partial cut-away view of the system according to the invention, showing the pick-up assembly, the impeller assembly, and the discharge tube.

In its Preferred Embodiment, the apparatus of the present invention is configured to be a snow removal system 1. FIG. 1 and FIG. 2 show the snow removal system i as it appears during operation. A pick-up assembly 4 is enclosed under a curved pick-up assembly housing 6 having a removable access cover 7; an impeller assembly 5 and discharge tube 70 are enclosed under an impeller assembly/discharge tube housing 8 having a removable access cover 9. During operation, the pick-up assembly 4 picks up snow and conveys it to the impeller assembly 5, which expels the snow into the discharge tube 70 whence it is discharged from the system 1 through discharge tube end 71. As can be seen in FIG. 1 and FIG. 2, the sides and tops of the pick-up assembly 4 and the impeller assembly 5 are fully enclosed during operation, thus preventing any unintended contact of operators or pedestrians with moving parts of the system 1. FIG. 10 is a partial cut-away view of the snow removal system 1 and illustrates the arrangement of the pick-up assembly 4, the impeller assembly 5, and the discharge tube 70.

Figure 3:
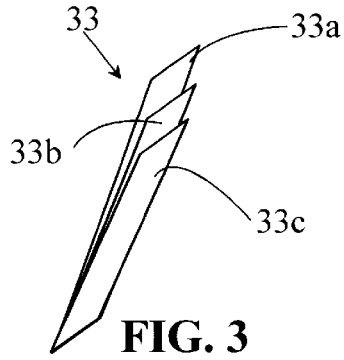
FIG. 3 is a perspective view of a finger module.
Figure 4:
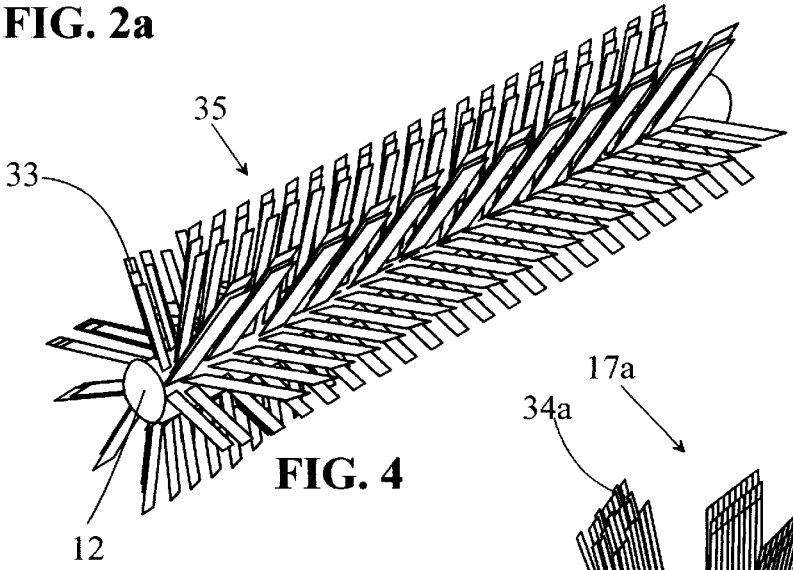
FIG. 4 shows a drum shaft with finger modules.
Figure 5A:
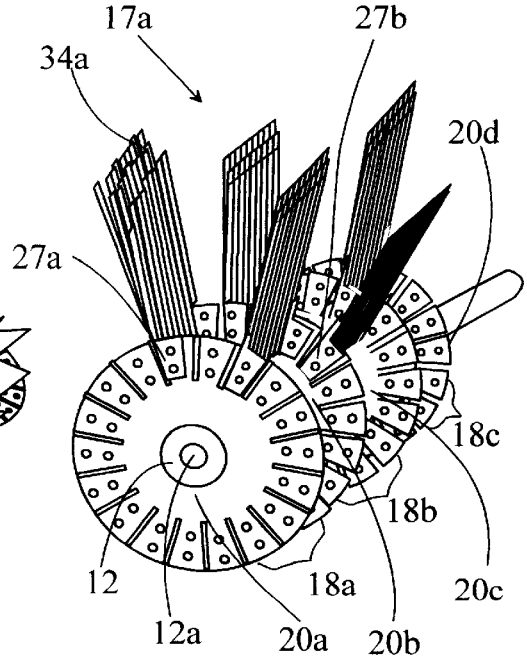
FIG. 5*a* shows a partially assembled drum array of the Preferred Embodiment.
Figure 5:
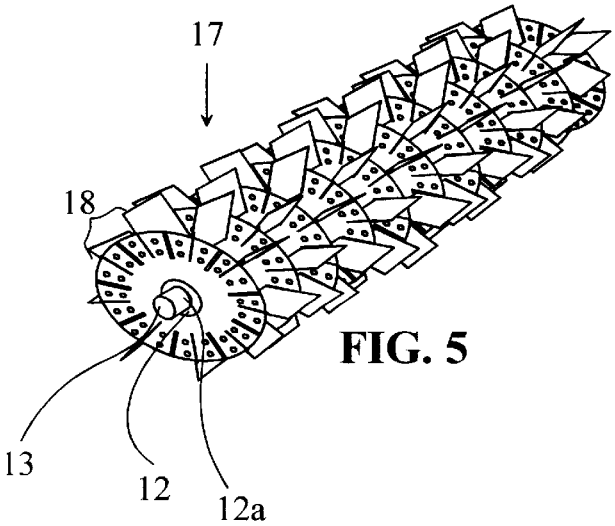
FIG. 5 shows a fully assembled drum array.

The heart of the invention lies in the use of a finger module 33 as a snow pick-up device on the pick-up assembly 4. As can be seen in FIG. 3, the finger module 33 of the Preferred Embodiment includes a triad of blade-like fingers including a long trailing finger 33*a*, a middle finger 33*b*, and a short leading finger 33*c*. The fingers 33*a*, 33*b*, 33*c* are fabricated of band or spring steel or any other material that is sufficiently strong to allow the fingers 33*a*, 33*b*, 33*c* to fracture and lift snow, yet flexible enough to allow them to bend when they contact the ground or fixed objects. Referring again to the Preferred Embodiment, the fingers 33*a*, 33*b*, 33*c* are approx. 1" in width, the trailing finger 33*a* is approximately 1" longer than the middle finger 33*b* and 2" longer than the leading finger 33*c*. Although the finger module 33 in the Preferred Embodiment has a triad of fingers, it is still within the scope of the present invention to have a pick-up drum 35 having a plurality of finger modules that include one or more fingers. Such a pick-up drum 35 is shown in FIG. 4. FIG. 5 shows a fully assembled drum array 17 of the pick-up assembly 4 and FIG. 5*a* shows a partially assembled drum array 17*a* according to the Preferred Embodiment. The drum array 17 contains a plurality of drums 18*a*, 18*b*, 18*c*, . . . , a drum shaft 12, and an inner shaft 12*a* having shaft ends 13. In the Preferred Embodiment, the drum shaft 12 is fabricated of schedule 80 steel pipe, 4" in diameter and approx. 87" in length, but could be made of any suitable length and be fabricated of any other material that is strong enough to withstand the forces applied to the shaft. The drum shaft 12 is fitted over the inner shaft 12*a*. This inner shaft 12*a* is a solid steel shaft 2 7/16" in diameter that extends the entire length of the drum array 17 with shaft ends 13 fitting into support bearings 206 (not shown) mounted on the floating chassis 2. FIG. 5*a* shows a partially assembled drum array 17*a* according to the Preferred Embodiment. A first drum 18*a* is formed by mounting a first drum disk 20*a* and a second drum disk 20*b* rigidly on the drum shaft 12 and mounting a plurality of first brackets 27*a* between the first drum disk 20*a* and the second drum disk 20*b* so that the plurality of first brackets 27*a* is distributed evenly around and aligned parallel to the drum shaft 12 and perpendicular to the first drum disk 20*a* and the second drum disk 20*b*. A plurality of first finger modules 34*a* is removably attached to each of the plurality of brackets 27*a*. A second drum 18*b* is formed by mounting an additional drum disk 20*c* on the drum shaft 12, then mounting a plurality of second brackets 27*b* between the second drum disk 20*b* and the additional drum disk 20*c*. A plurality of second finger modules 34*b* is removably attached to each of the plurality of second brackets 27*b*. Subsequent drums 18*c*, . . . , are formed in a similar manner. As shown in FIG. 5, in the Preferred Embodiment the plurality of first brackets 27*a* of the first drum module 18*a* is radially offset to the plurality of second brackets 27*b* of the second drum 18*b*, and this manner of offsetting is continued in the subsequent drums 18*c*, . . . This arrangement distributes in time the load on the drum shaft 12, reducing maximum torsional stress and also vibrations. In the Preferred Embodiment, the diameter of the completely assembled drum array 17 is about 30 inches. Although the drum array 17 according to the Preferred Embodiment of the invention as shown in FIG. 5*a* includes a plurality of drums 18*a*, 18*b*, 18*c*, . . . , the scope of the invention is not limited to the drum array 17. A pick-up assembly could comprise a single drum mounted on a shaft.

Figure 6:
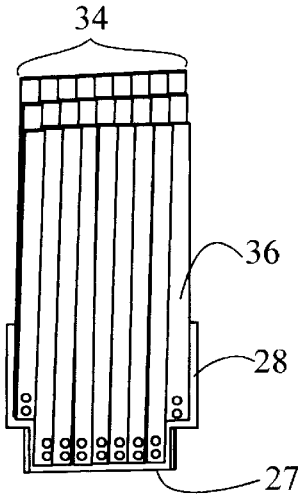
FIG. 6 is a frontal view of a bracket with finger modules.

Each of the plurality of first brackets 27*a* and of the plurality of second brackets 27*b* has the form of a bracket 27, shown in FIG. 6. According to the Preferred Embodiment, a group of nine finger modules 34 is removably attached to the bracket 27. FIG. 6 also shows a bracket overlap 28 that extends laterally beyond the mounting width of the bracket 27. An overlap finger module 36 is attached to this bracket overlap 28. The purpose of the bracket overlap 28 is to allow the finger module 36 to pick up snow spillage from an adjoining drum module 18.

Figure 7:
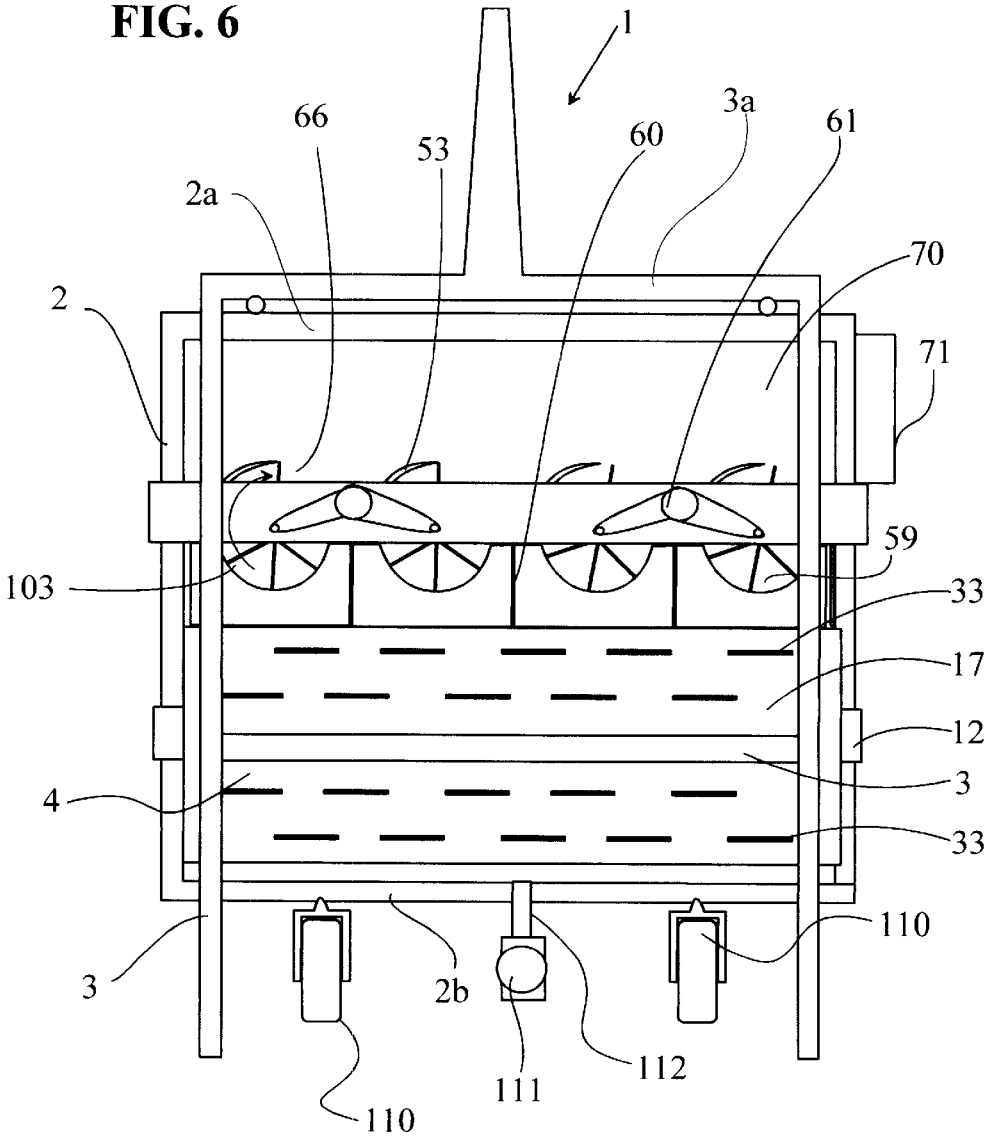
FIG. 7 is a top view of the system with housings and covers removed.
Figure 8A:
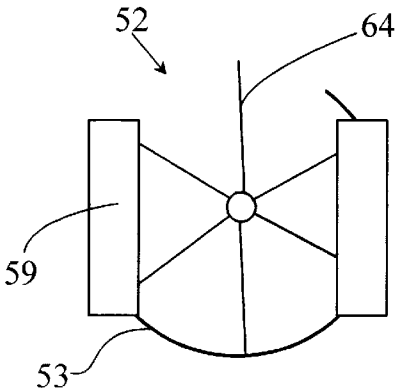
FIG. 8*a* is a top view of the chamber wall and blade set of an impeller unit.
Figure 8B:
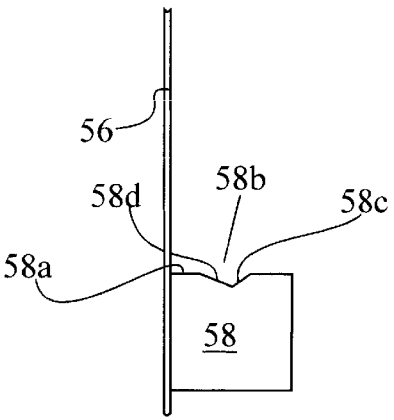
FIG. 8*b* is an elevational view of the blade set.
Figure 8:
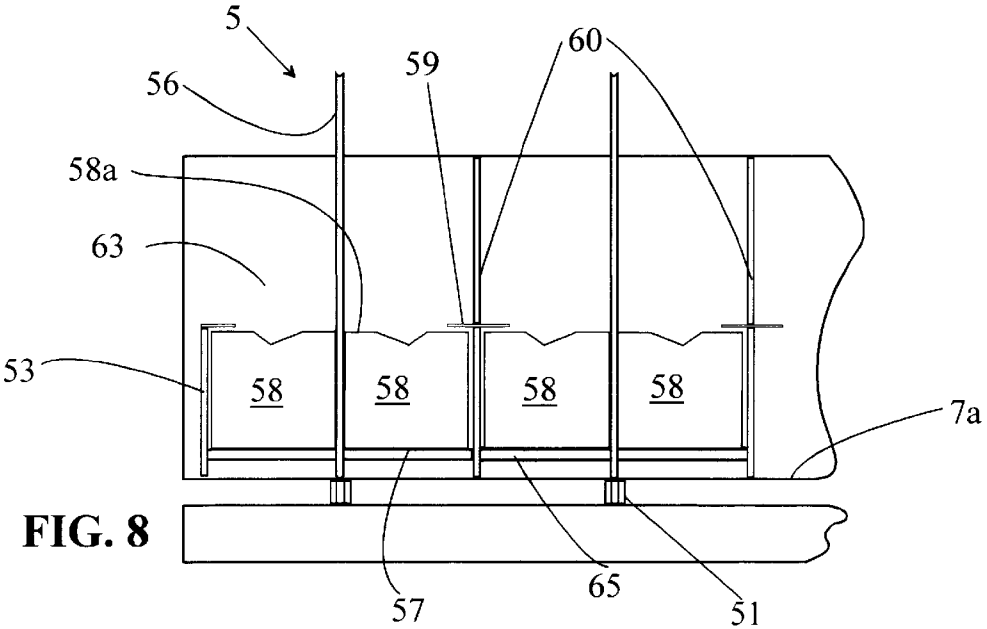
FIG. 8 is a frontal view of the impeller assembly.
Figure 9:
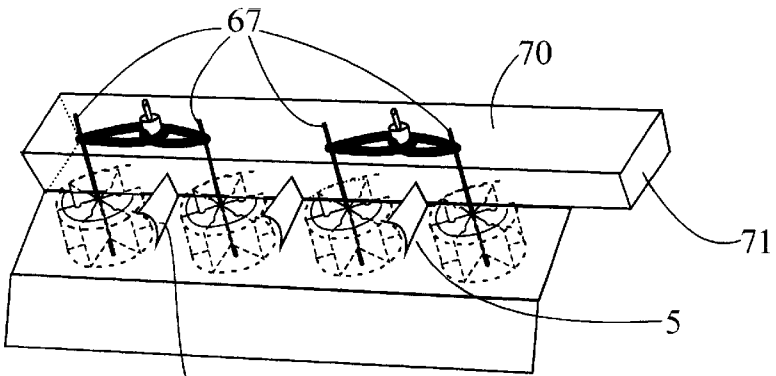
FIG. 9 is a perspective view of an impeller assembly and discharge tube.

Another key component of the invention is the impeller assembly 5. As shown in FIG. 7, FIG. 8, FIG. 8*a,* and FIG. 9, the impeller assembly 5 of the Preferred Embodiment includes four impeller units 67, each of the four impeller units 67 includes an impeller chamber 52 formed by an impeller wall 53 and an impeller chamber cover 59, an impeller intake 63 formed by a divider plate 60, an impeller exit 66, an impeller shaft 56, an impeller blade array 64, and an impeller base plate 57. As shown in FIG. 8, the impeller base plate 57 is rigidly and permanently connected to the impeller shaft 56 which is rotatably mounted on a lower support bearing 51. The impeller blade array 64 is rigidly and permanently attached to the impeller shaft 56 and the impeller base plate 57. In the Preferred Embodiment, the impeller blade array 64 includes six blades 58, each of which is flat and substantially rectangular. As can be seen in FIG. 8*b,* the upper blade edge 58*a* is notched to improve the flow of the snow down into the impeller chamber and, also, to reduce noise. In the Preferred Embodiment, a notch 58*b* has an outer leg 58*c* and an inner leg 58*d,* the ratio of the length of the outer leg 58*c* to the length of the inner leg 58*d* being 2:3. The four impeller units 67 are mounted such that an axis passing through each of the four impeller units 67 lies parallel to the discharge tube 70 and the pick-up assembly 4. FIG. 9 shows the divider plate 60 mounted vertically between the impeller cover plate 59 of any two of the four impeller units 67. As seen in FIG. 8 and FIG. 9, the divider plate 60 creates a separate impeller intake 63 above each impeller unit 67 and serves to reduce the amount of air crossflow across the four impeller units 67, thereby improving the suction and reducing the amount of snow spillage. As shown in FIG. 1, snow is discharged to the right through the discharge tube end 71. The impeller action is reversible in direction and, therefore, in other embodiments the snow can be discharged to the left or to the left and the right simultaneously, as desired. When snow is discharged to one side only, a guide plate can be installed in the discharge tube 70 at the end opposite the discharge tube end 71 or the shape of the impeller assembly/discharge tube housing 8 can be modified to prevent snow from accumulating in a comer area of the non-discharging end of the discharge tube 70. FIG. 8 shows a Teflon disk 65 placed between the impeller assembly housing floor 8*a* and the base impeller plate 57 to prevent the impeller base plate 57 from freezing to the impeller assembly housing floor 8*a.* Other means for preventing ice from forming in the gap between the base plate 57 and the impeller assembly housing floor 8*a* can also be used.

The pick-up assembly 4 with the pick-up assembly housing 6 and the impeller-assembly/discharge-tube housing 8 including the impeller assembly 5 and the discharge tube 70 are mounted on the floating chassis 2 that is suspended from a fixed chassis 3. In the Preferred Embodiment, the floating chassis front end 2*a* is attached to the fixed chassis front end crossbar 3*a* by means of a clevis pin 80 which allows the front end 2*a* to pivot about the fixed chassis front end crossbar 3*a*. As shown in FIG. 1 and FIG. 2, a pair of standard dolly wheels 110, a lifting frame 112, and a known lifting means, such as a lifting ram 111, can be used to adjust the height of the floating chassis rear end 2*b*. In the Preferred Embodiment, the dolly wheels 110 are mounted on each side of the floating chassis rear end 2*b* and the lifting frame 112 is mounted in the center of the floating chassis rear end 2*b*. The lifting ram 111 is mounted on a power deck 300 and attached to the lifting frame 112. In the Preferred Embodiment, the floating chassis rear end 2*b* has three operating positions: (a) In its working position, the floating chassis rear end 2*b* rests on the dolly wheels 110. The dolly wheels 110 are sized such that the tip of the middle finger 33*b* of the finger module 33 just grazes the ground when the floating chassis rear end 2*b* is supported by the dolly wheels 110. As the system is operated, the dolly wheels 110 follow the contour of the ground surface, allowing the pick-up assembly 4 to follow the same contour. To adjust the working position of the floating chassis 2, the length of the lifting ram 111 is adjusted until the dolly wheels 110 touch the ground and is then retracted approximately another inch. If the dolly wheels 110 should drop down into a recession in the ground, such as into a large pothole, the floating chassis rear end 2*b* will drop down only the distance that the lifting ram 111 was retracted after adjusting the height of the floating chassis rear end 2*b* because the lifting frame 112 will come to rest on the lifting ram 111, preventing the floating chassis rear end 2*b* from dropping further. This is done to protect the drum array 17 from being damaged by hitting the ground surface. (b) For an idle position, the lifting ram 111 can be extended to push up against the lifting frame 112, raising the floating chassis rear end 2*b* until the tip of the trailing finger 33*a,* at its lowest position, is one to two inches above ground. (c) When the system is in transit, the lifting ram 111 can be used to raise the position of the floating chassis rear end 2*b* high enough so that the lowest position of the trailing finger 33*a* is six to eight inches above ground. For maintenance and repair work, the floating chassis rear end 2*b* can be raised still higher by the lifting ram 111 or the fixed chassis 3 can be raised to provide easy access to the pick-up assembly 4, the impeller assembly 5, and the discharge tube 70.

The fixed chassis 3 can be hitched to or mounted on a prime mover which pushes or pulls the system 1 along the surface to be cleared of snow. In the Preferred Embodiment, the system 1 is hitched to a prime mover which pulls the system and powered by a commercially available hydraulic power unit that is carried external to the system on a power deck 300 shown schematically in FIG. 1 and FIG. 2. The fixed chassis rear support 3*b* is mounted on the power deck 300. The drive motors for the drum and the impeller assembly are mounted externally on the floating chassis 2 and are shown in FIG. 1, FIG. 2, and FIG. 7. Although the hydraulic power unit is shown carried on the power deck 300 in the Preferred Embodiment, it may be mounted externally to the snow removal system 1 in a variety of ways. Such power units and the methods of powering such equipment as that of the present invention are well-known to those skilled in the art and are not included within the scope of this invention. The belt shields 201 that cover the two hydraulic drum-shaft-drive motors 40 and the belt shields 207 that cover the two hydraulic impeller-drive motors 61 can be seen in FIGS. 1 and 2. Any commercially available hydraulic motor that provides sufficient power to drive the drum shaft, such as 20 HP hydraulic drive motors, can serve as the drive motors 40 to drive the drum shaft 12 of the pick-up assembly 4. Commercially available motors, such as White Hydraulics RS-Series, Model 10, can serve as drive motors 61 to drive the impeller units 67 of the impeller assembly. Although this invention uses a hydraulic power system with two drive motors 40 for the drum assembly and two drive motors 61 for the impeller assembly, it is understood that it is within the scope of this invention if a different number of motors or other suitable means of driving the drum shaft and the impeller shafts are used.

When the system 1 is operating in its normal mode, the drum array 17 of the pick-up assembly 4 rotates as illustrated by a directional arrow 102 in FIG. 2. A directional arrow 101 indicates the direction of travel of the system. For purposes of illustration, FIG. 7 shows the system 1 with the pick-up assembly access cover 7 and the impeller assembly/discharge tube access cover 9 removed. The finger modules 33 on the drum array 17 pick up snow as the drum array 17 rotates around the drum shaft 12 and convey the snow to the impeller intake 63 of each of the four impeller units 67 of the impeller assembly 5. The impeller intake 63 is an open chamber extending across all four impeller units 67, as shown in FIG. 8. In the Preferred Embodiment, the impeller units 67, rotating in the direction indicated by arrow 103, transport the snow around the impeller chamber 52 and fling the snow into the discharge tube 70, whence it is then discharged at right angles to the direction of travel of the system 1 through a discharge tube end 71. In the Preferred Embodiment, and as shown in FIG. 2, the discharge tube 70 is formed by the impeller assembly/discharge tube housing 8, and the discharge tube end 71 is located at the right end of the discharge tube 70. It is understood that the discharge tube end 71 can be located at either the left or right end of the discharge tube 70. In the Preferred Embodiment, the plane of the impeller assembly 5 and the discharge tube 70 is tilted upward approximately 20° relative to the ground so that the plane of the impeller intakes 63 is tilted toward the pick-up assembly, as shown in FIG. 2. It is possible to adjust the tilt of the plane of the impeller assembly 5 and discharge tube 70 to a greater angle relative to the ground. For example, a first section of the floating chassis 2*c* that supports the impeller assembly 5 and the discharge tube 70 can be pivotally attached to a second section of the floating chassis 2*d* that supports the pick-up assembly, as shown in FIG. 2 at 2*e*. A hydraulic piston (not shown) can be mounted on each side of the floating chassis 2 on the second section of the floating chassis 2*d* and attach to each side of the discharge tube 70 such that, when the piston is retracted the tilt the plane of the impeller assembly 5 and the discharge tube 70 is adjusted to a steeper tilt.

FIG. 2 shows a side view of the pick-up assembly 4 and the impeller assembly 5 with the discharge tube end 71. In the Preferred Embodiment, as shown in FIG. 2, a rear pick-up plate 11, hingedly attached to the floating chassis 2 and extending parallel to the pick-up assembly 4, extends below the pick-up assembly housing 6. This rear pick-up plate 11 is flexible so that it can drag across protrusions in the ground surface. The purpose of the rear-pick-up plate 11 is to keep within the pick-up assembly area any snow that is not engaged and lifted by the pick-up assembly 4 so that the snow can be picked up during the continuing rotation of the pick-up assembly 4. Also seen in FIG. 2 is an inclined feed plate 10, fabricated of a rigid, smooth material such as steel, and hingedly attached to the floating chassis 2 so that it extends parallel to the axis of the pick-up assembly 4 and, as can be seen in FIG. 2, extends below the pick-up assembly housing 6. The lower inclined feed plate edge 10*b* is a distance from the ground that corresponds to the depth of snow the system 1 is designed to clear, which, in this Preferred Embodiment, is approximately four inches. Thus, the inclined feed plate 10 skims across the surface of the snow, providing a smooth, non-sticky surface against which the snow that is being lifted by the pick-up assembly 4 can slide and creep upward toward the impeller assembly 5.

Figure 2A:
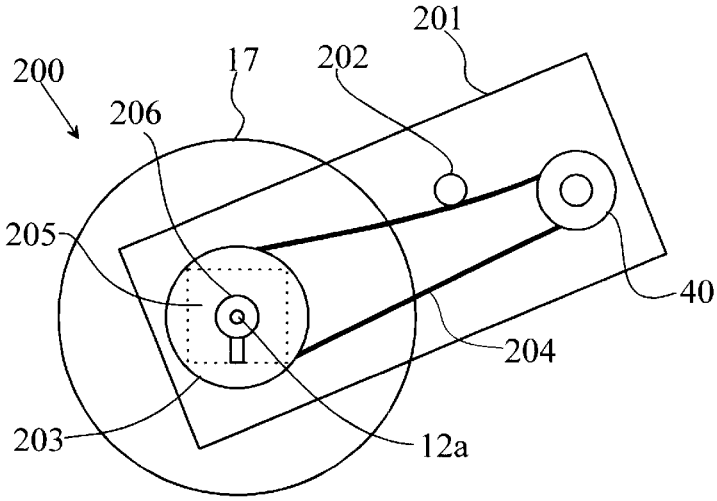
FIG. 2*a* is a schematic drawing of the drum mounting and drum motor drive.

The Preferred Embodiment of the system 1 according to the present invention is designed to be a versatile, multi-purpose system for removing snow and other debris from ground surfaces. To this end, the drum array 17 of the Preferred Embodiment can be easily and quickly exchanged for a drum or drum array configured for a cleaning operation other than snow removal mounted. FIG. 2*a* shows a drive arrangement 200. To exchange the drum array 17 for another drum or drum array, the belt shield 201 and the pick-up assembly housing end shield 6*a*, attached to pick-up assembly housing 6 at each end of the pick-up assembly 4, are removed. The belt tensioner 202, the drive belt 204, and the main drive pulley 203 are removed from each end of the drum array 17, exposing each end of the inner drive shaft 12*a*. Two standard, commercially available rolling carriages, each fitted with a pillow block bearing, are positioned at each end of the drive shaft 12 and adjusted in height until the rolling carriages are bearing the weight of the drum array 17. Fasteners are removed from a drum mounting plate 205 which is arranged at each shaft end 12*a* for mounting the drum array 17 on the floating chassis 2. The rear pick-up plate 11 and the inclined feed plate 10 are loosened so as to allow the rear pick-up plate 11 and the inclined feed plate 10 to swing down and free of the drum array 17. Using the hydraulic ram 111, the floating chassis rear end 2*b* can be raised until the pick-up assembly housing 6 clears the drum array 17. The drum array 17 can now be wheeled out from under the pick-up assembly 4. To install another drum or drum array, the process is reversed. In the Preferred Embodiment, the time estimated to exchange drums is approximately 1 hour.

Figure 11:
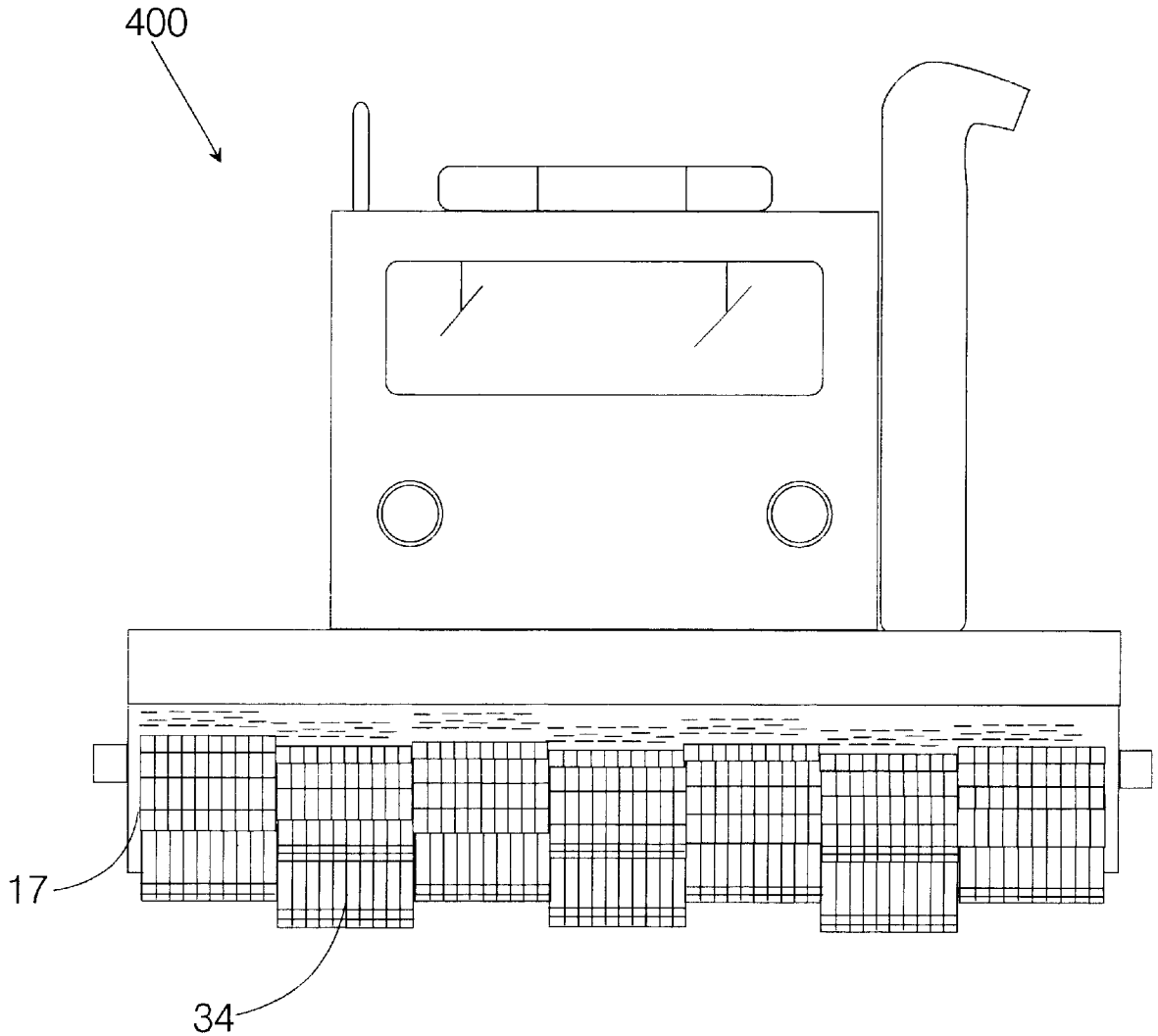
FIG. 11 is a perspective view of the drum array according to the invention, installed in a conventional airport sweeper.

The drum array 17 itself can also be mounted on equipment other than the system 1 of the Preferred Embodiment. FIG. 11 shows the drum array 17 according to the invention mounted on a conventional runway sweeper 400. This illustration of the drum array 17 is merely an illustrative example of the many and varied uses of the drum array 17 as a ground-surface cleaning module that can be installed in conventional equipment. The drum array 17 can be used in place of conventional ground-surface cleaning sweepers or brooms, including sweepers for large-scale cleaning operations such as are operated by municipal public works departments and other large facilities. Furthermore, the drum array 17 can be used in powered sweepers constructed on a much smaller scale and intended for homeowner use.

While a Preferred Embodiment is disclosed herein, this is not intended to be limiting. Rather, the general principles set forth herein are considered to be merely illustrative of the scope of the present invention and it is to be further understood that numerous changes may be made without straying from the scope of the present invention.

I claim:

1. In combination with a conventional prime mover, an apparatus for removing snow or debris from a ground surface, said apparatus comprising:

a rotatable drum array having an outer circumference, a plurality of brackets, and a plurality of finger modules, wherein said plurality of finger modules is arranged on each of said brackets and said brackets are arranged radially around said outer circumference of said rotatable drum, wherein each finger module of said plurality of finger modules has an assembly end and an operating end, each said finger module comprising two or more fingers that include at least a first finger and a second finger, wherein each finger of said two or more fingers is a flat blade of stiffly flexible material and has a sweep end and a finger length, and wherein, when said two or more fingers are assembled to form said finger module, said first finger and said second finger are assembled on atop the other, in close proximity to another, such that said sweep end of said first finger extends beyond said sweep end of said second finger so as to form a stepped configuration of said operating end of said finger module.

2. The apparatus as described in claim 1, wherein each of said finger modules is a triad of stepped fingers: a leading finger, a middle finger, and a trailing finger, said leading finger being shorter than said middle finger, said middle finger being shorter than said trailing finger.

3. The apparatus as described in claim 1, wherein said apparatus is mounted at the front of the prime mover.

4. The apparatus as described in claim 1, wherein said apparatus is mounted at the rear of the prime mover.

5. The apparatus as described in claim 1, wherein said apparatus is pulled behind the prime mover.

6. The apparatus as described in claim 1, wherein said prime mover is a large horsepower vehicle used for cleaning airport runways.

7. The apparatus as described in claim 1, wherein said prime mover is a large horsepower truck used for cleaning roadways.

8. The apparatus as described in claim 1, wherein said prime mover is a small horsepower vehicle used for yard and driveway sweepers.

* * * * *